US007854408B2

(12) United States Patent
Baumhoff

(10) Patent No.: US 7,854,408 B2
(45) Date of Patent: Dec. 21, 2010

(54) DOUBLE SPREAD-HEAD CAROUSEL WINDER

(75) Inventor: Alfons Baumhoff, Kirchhundem (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 86 days.

(21) Appl. No.: 12/374,375

(22) PCT Filed: Jul. 31, 2007

(86) PCT No.: PCT/EP2007/006751

§ 371 (c)(1),
(2), (4) Date: Jan. 20, 2009

(87) PCT Pub. No.: WO2008/019758

PCT Pub. Date: Feb. 21, 2008

(65) Prior Publication Data

US 2009/0294569 A1 Dec. 3, 2009

(30) Foreign Application Priority Data

Aug. 16, 2006 (DE) ..... 10 2006 038 493

(51) Int. Cl.
*B65H 19/22* (2006.01)

(52) U.S. Cl. ..... 242/533.4; 242/533.5; 242/533.6; 242/533.7

(58) Field of Classification Search ..... 242/533.4–7, 242/559.2

See application file for complete search history.

(56) References Cited

U.S. PATENT DOCUMENTS 2,586,832 A 2/1952 Kohler ..... 242/523.1
3,207,452 A * 9/1965 Haskin, Jr. et al. ..... 242/533.4
3,298,624 A * 1/1967 Schott, Jr. ..... 242/533.6
3,486,708 A * 12/1969 Lamon ..... 242/422.1
5,695,150 A 12/1997 Chevet ..... 242/533.6
5,921,498 A 7/1999 Wessel ..... 242/533.6
5,934,602 A 8/1999 Jendroska ..... 242/533.6
6,283,403 B1 9/2001 Braun ..... 242/532.2
6,364,242 B1 4/2002 Braun ..... 242/532
6,739,546 B2 * 5/2004 Hashimoto ..... 242/559.2

FOREIGN PATENT DOCUMENTS

JP 62142022 A * 6/1987
JP 06262255 9/1994

* cited by examiner

*Primary Examiner*—Sang Kim
(74) *Attorney, Agent, or Firm*—Andrew Wilford

(57) ABSTRACT

A carousel coiler with two coilers, which are mounted in a rotatable rotor, are rotatably driven independently of each other, are intended for the successive, continuous winding of metal strip and each have spray heads, which comprise a number of segments that can be moved in a spreading manner, are supported on axially displaceable wedge-shaped directing surfaces and on which the coilers can be cyclically moved in each case from a starting position into a strip-coil transfer position by turning of the rotor, is to be developed in such a way that a pivot-into-place outside bearing becomes superfluous, that the coil or the coil to be wound is always supported on both sides in every position, and that the carousel coiler can be used both for winding up and unwinding coils. For this purpose, it is proposed that the rotor comprises two rotor discs (2, 2'), which are opposite each other and connected to each other by at least one hollow cross-member (3) and that the rotor carries at least two double spray-head coilers.

7 Claims, 1 Drawing Sheet

DOUBLE SPREAD-HEAD CAROUSEL WINDER

CROSS REFERENCE TO RELATED APPLICATIONS

This application is the U.S. national phase of PCT application PCT/EP2007/006751, filed 31 Jul. 2007, published 21 Feb. 2008 as WO2008/019758, and claiming the priority of German patent application 102006038493.8 itself filed 16 Aug. 2006, whose entire disclosures are herewith incorporated by reference.

FIELD OF THE INVENTION

The invention relates to a carousel winder having two winders that are carried in a rotatable rotor, that can be rotationally driven independent of one another, that are intended for successive continuous winding of metal strip, and that each have two spreadable heads that in turn each comprise a plurality of spreadable segments that are axially slidable on wedge surfaces, and in which the winders can be cycled between a coil transfer position and a starting position by rotation of the rotor.

Such carousel winders have become known, e.g. from DE 198 36 159 [U.S. Pat. No. 6,283,403]. They have cantilevered winder mandrels so that a weight limit for the coil to be carried or wound results from the one-ended mounting. If heavy coils are to be wound, the winder mandrel and the rotor must be made with the necessary strength.

Also known in carousel winders is winding the strip on an end-supported mandrel. The rotor is then pivoted from the starting winding position to the finish winding position. In this finish winding position an outer bearing is pivoted such that the outer end of the mandrel is supported. Heavy coils can then be wound in this position. But because of the high strip tension the winder mandrel rapidly is stressed to its limit when it has just been rotated into the finished position. The limit for the loads are rapidly attained even when the strip is removed from the winder mandrel that is no longer supported. In addition, there is the complex construction for pivoting the outer bearing.

OBJECT OF THE INVENTION

The basic object of the invention is to provide a carousel winder such that no pivotal outer bearing is needed, such that the coil or the coil to be wound is always bilaterally supported in each position, and such that the carousel winder can be used both for winding and unwinding coils.

SUMMARY OF THE INVENTION

To this end it is suggested that the rotor comprises two mutually opposing rotor disks that are joined to one another by at least one tubular beam and that the rotor carries at least two double spreadable head winders. When positioned together, the two spreadable heads that belong to one double head winder form a winding drum that provides continuous bilateral support for the strip, i.e. the strip has bilateral support even when the rotor is turning. There is no weight or strip tensile limit for the coil that results from being supported at only one end.

It is worth noting that the rotor disks are also joined to one another by at least two guides.

It is advantageous when the winders for each double spreadable head winder are carried by mutually opposing mandrel holders and face one another and that the mandrel holders for each double spreadable head winder are supported on the guides and/or the tubular beam such that they can be displaced toward one another and away from one another. Because of this, when positioned together, the two spreadable heads that belong to one double spreadable head winder are used to start winding, to wind up strip, and to unwind strip, even strip that has different widths. The coil can be removed when the spreadable heads are moved apart from each other.

It is important that at least one rotationally driven spline shaft is carried in the tubular beam and that the mandrel holders have drive elements that are mechanically linked to the spline shaft and that are also mechanically linked to the spreadable heads of the double spreadable head winder.

It has proven advantageous for the spline shaft to be divided longitudinally into two parts. The spline shafts can thus be rotationally driven by two different drives.

It is significant that the tubular beam is slotted and the mechanical link for the drive elements and the spline shafts extends through the slot.

It is advantageous that the rotor disks are carried on tensioning rollers and at least one of the rotor disks is rotationally driven about the axis of the tubular beam and the spline shafts. Thus the mandrel holders can be pivoted e.g. from a starting winding position to a finish winding position.

It is recommended that the tubular beam have approximately in the center at least one abutment for the mandrel holders and that piston cylinder units be arranged between the abutments and the mandrel holders in order to displace and position the mandrel holders axially.

It is advantageous that two abutments are provided, each abutment carrying one of the two bearings for the two-part spline shaft.

In addition, latch elements that keep the abutments in position can be provided.

It is useful that the spline shafts and/or the rotor disks have separate drives. The drives can preferably be matched to one another in terms of their action, e.g. can be synchronized to one another.

BRIEF DESCRIPTION OF THE DRAWING

The invention is described in greater detail with reference to the drawings.

SPECIFIC DESCRIPTION

Figure 1:
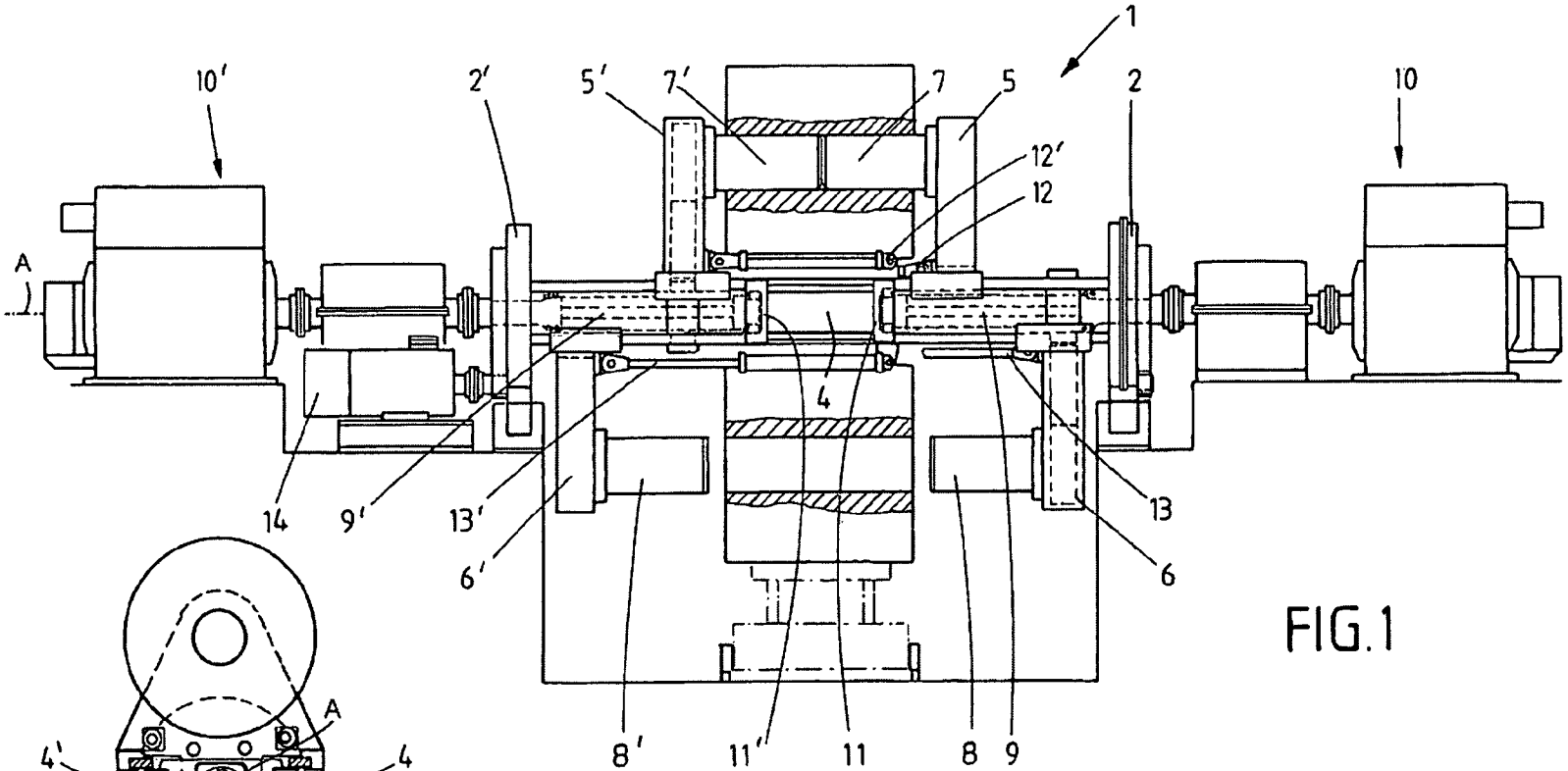
FIG. 1 is a front elevation of the inventive carousel winder.
Figure 2:
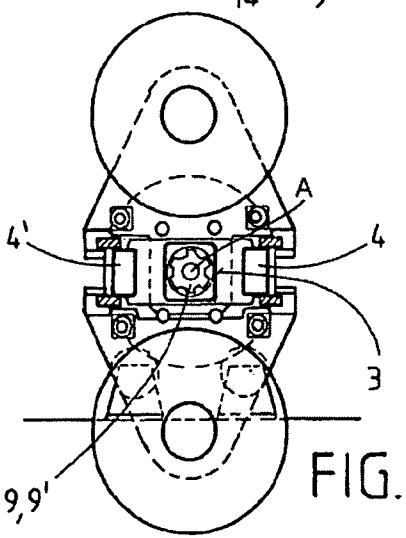
FIG. 2 is a side elevation of the inventive carousel winder.

The figures depict a carousel winder 1 that has two rotor disks 2 and 2' that are joined to one another by a tubular beam 3 and by two guides 4 and 4'.

The guides 4 and 4' carry pairs of mandrel holders 5, 5', 6, and 6' such that they can be moved toward and away from one another. The mandrel holders 5 and 6 have spreadable winder heads 7 and 7' and 8 and 8'.

A two-part spline shaft 9 and 9' extends inside the tubular beam 3. The free ends of the spline shafts 9 and 9' that are rotationally driven via drives 10 and 10' are held in bearings provided in abutments 11 and 11'. Piston cylinder units 12 and 12'; 13 and 13' are arranged between the abutments 11 and 11' and the mandrel holders 5 and 5'; 6 and 6'. The rotor disk 2' can be rotated by a drive 14.

The invention claimed is:

1. An apparatus for winding up a strip, the apparatus comprising:

a pair of rotor disks spaced along and rotatable about an axis;

a beam extending axially between and fixing the disks together for joint synchronous rotation;

two angularly offset pairs of axially spaced holders axially shiftable along the beam;

a respective spreadable head on each of the holders, the head of one of the holders being axially aligned with the head of the other of the holders of the respective pair;

means for rotating the disks, beam, and holders synchronously about the axis with the pairs of heads traveling angularly between a winding position and a transfer position offset angularly from the winding position;

a pair of drive shafts extending along the axis inside the beam;

respective means for transmitting torque from each of the shafts to a respective one of the heads of each of the pairs;

respective drive means connected to the shafts for rotating the shafts and thereby rotating the respective winding heads and winding up a strip engaged with the winding heads; and respective actuators for axially shifting each of the holders on the beams independently of the other holders between a closely juxtaposed position when in the winding position for holding and winding a strip and a widely juxtaposed position when in the transfer position for removal of a wound strip.

2. The winding apparatus defined in claim 1 wherein the beam is formed with a longitudinally extending slot and the means for transmitting torque extends through the slot.

3. The winding apparatus defined in claim 1 wherein each holder is an arm having an inner end riding on the beam and an outer end carrying the respective head.

4. The winding apparatus defined in claim 3 wherein the arms are angularly equispaced on the beam.

5. The winding apparatus defined in claim 1 wherein the actuators each extend axially and each have having one end fixed to the beam and an opposite end fixed to a respective one of the holders.

6. The winding apparatus defined in claim 1 wherein the beam includes guides along which the holders are axially displaceable.

7. The winding apparatus defined in claim 1 wherein the shafts each have an outer end projecting axially out past the respective disk and an inner end, the drive means each being axially outside the respective disk and connected to the respective outer end.

* * * * *